US009559442B2

(12) United States Patent
Hama et al.

(10) Patent No.: US 9,559,442 B2
(45) Date of Patent: Jan. 31, 2017

(54) SEQUENCER TERMINAL BLOCK, SEQUENCER, AND SEQUENCER UNIT

(71) Applicants: Akimasa Hama, Tokyo (JP); Atsunori Aoki, Tokyo (JP); Manabu Kawasaki, Tokyo (JP)

(72) Inventors: Akimasa Hama, Tokyo (JP); Atsunori Aoki, Tokyo (JP); Manabu Kawasaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/766,816

(22) PCT Filed: Mar. 29, 2013

(86) PCT No.: PCT/JP2013/059601
§ 371 (c)(1),
(2) Date: Aug. 10, 2015

(87) PCT Pub. No.: WO2014/155694
PCT Pub. Date: Oct. 2, 2014

(65) Prior Publication Data

US 2016/0043483 A1 Feb. 11, 2016

(51) Int. Cl.
*H01R 9/22* (2006.01)
*H01R 9/24* (2006.01)

(52) U.S. Cl.
CPC ..... *H01R 9/2416* (2013.01)

(58) Field of Classification Search
CPC ..... H01R 13/562; H01R 9/2416
(Continued)

(56) References Cited

U.S. PATENT DOCUMENTS 3,783,436 A * 1/1974 Bury ..... H01R 13/743 174/153 G
4,358,178 A * 11/1982 Guy ..... H01R 13/516 439/464

(Continued)

FOREIGN PATENT DOCUMENTS

JP 49-111193 A 10/1974
JP 50-144985 A 11/1975

(Continued)

OTHER PUBLICATIONS

International Search Report for PCT/JP2013/059601 dated Jun. 25, 2013 [PCT/ISA/210].

(Continued)

*Primary Examiner* — Abdullah Riyami
*Assistant Examiner* — Nelson R Burgos-Guntin
(74) *Attorney, Agent, or Firm* — Sughrue Mion, PLLC; Richard C. Turner

(57) ABSTRACT

To provide a sequencer terminal block having a terminal connection surface on which a plurality of terminal connection portions, to which terminals can be respectively connected, are arrayed. The sequencer terminal block includes a band attachment portion formed to protrude in a first direction parallel to an array direction of the terminal connection portions. The band attachment portion includes two first legs formed to protrude in the first direction, and a first joining portion that joins ends of the first legs to each other. An area surrounded by an attachment-portion forming surface on which the band attachment portion is formed, the first legs, and the first joining portion becomes an insertion hole into which a banding band can be inserted.

5 Claims, 10 Drawing Sheets

(58) Field of Classification Search
USPC ..... 439/709, 470, 471, 472, 719
See application file for complete search history.

(56) References Cited

U.S. PATENT DOCUMENTS 4,443,051 A * 4/1984 Aguilar ..... H01R 13/582 439/470
4,526,435 A * 7/1985 Borne ..... H01R 13/5804 439/470
D299,492 S * 1/1989 Gregson ..... 439/719
5,158,476 A * 10/1992 Kirby ..... H01R 23/661 439/458
5,435,760 A * 7/1995 Miklos ..... H01R 13/516 285/92
5,455,744 A * 10/1995 Watanabe ..... H05K 7/1467 174/250
5,620,333 A * 4/1997 Boyle ..... H01R 13/516 439/471
5,697,809 A * 12/1997 Chung ..... H01R 13/72 174/129 B
5,700,156 A * 12/1997 Bussard ..... H01R 13/5804 439/471
5,761,960 A * 6/1998 Nagai ..... B23Q 5/38 108/143
5,910,026 A * 6/1999 Geib ..... H01R 13/506 439/464
5,911,595 A * 6/1999 Orr, Jr. ..... H01R 13/58 439/471
5,929,381 A * 7/1999 Daoud ..... G02B 6/4448 174/135
5,977,486 A * 11/1999 Fujita ..... F16L 5/02 174/152 R
6,019,645 A * 2/2000 Avery ..... H01R 13/4367 439/449
6,478,609 B1 * 11/2002 Davis ..... H01R 13/5812 439/465
6,491,539 B1 * 12/2002 Johnston ..... H01R 13/6395 439/369
6,527,582 B1 * 3/2003 Boudreaux ..... H05K 5/0247 439/449
6,619,997 B1 * 9/2003 Wilson ..... H01R 9/2416 439/371
6,679,722 B1 * 1/2004 Pulizzi ..... H01R 13/562 439/451
7,001,223 B1 * 2/2006 Shiu ..... H02G 3/30 439/719
7,039,183 B2 * 5/2006 Zielke ..... H01R 4/34 379/413.04
7,070,454 B1 * 7/2006 Pepe ..... H01R 31/005 439/464
7,488,196 B2 * 2/2009 Kocher ..... H01R 4/26 439/393
7,800,468 B2 * 9/2010 Bogdon ..... H01H 71/0228 200/293
8,313,340 B2 * 11/2012 Krueger ..... H01R 13/5812 439/446
8,647,142 B1 * 2/2014 Kershaw ..... H01R 13/639 439/368
8,770,994 B1 * 7/2014 Fagan ..... H01R 13/44 439/141
8,934,253 B2 * 1/2015 Anderson ..... G02B 6/4452 361/679.36
2003/0022550 A1 * 1/2003 Chowdhury ..... H01R 13/6397 439/488
2004/0072457 A1 * 4/2004 Conway ..... H01R 12/7064 439/153
2005/0106948 A1 * 5/2005 Peng ..... H02G 3/32 439/719
2007/0117476 A1 * 5/2007 Kumakura ..... H01R 4/182 439/885
2011/0207362 A1 * 8/2011 Lifson ..... H01R 13/6392 439/369
2013/0196532 A1 * 8/2013 Utz ..... H01R 13/5812 439/471
2015/0372422 A1 * 12/2015 Brown ..... H01R 13/6392 439/369
2016/0043483 A1 * 2/2016 Hama ..... H01R 9/2416 439/709

FOREIGN PATENT DOCUMENTS

JP 54-131091 A 9/1979
JP 58-095686 U 6/1983
JP 61-063776 U 4/1986
JP 63-105390 U 7/1988
JP 02-142585 U 12/1990
JP 03-006881 U 1/1991
JP 04-063183 U 5/1992
JP 2532946 Y2 4/1997
JP 10-021797 A 1/1998
JP 11-329574 A 11/1999
JP 2003-224377 A 8/2003
JP 2010-282764 A 12/2010

OTHER PUBLICATIONS

Written Opinion for PCT/JP2013/059601 dated Jun. 25, 2013 [PCT/ISA/237].
Japanese Office Action of JP 2013-539471 dated Dec. 10, 2013.
Taiwanese Office Action of TW of TW 102135970 dated Mar. 25, 2015.
Communication dated Jul. 29, 2016, issued by the Korean Intellectual Property Office in corresponding Korean Application No. 10-2015-7025313.

* cited by examiner

SEQUENCER TERMINAL BLOCK, SEQUENCER, AND SEQUENCER UNIT

CROSS REFERENCE TO RELATED APPLICATIONS

This application is a National Stage of International Application No. PCT/JP2013/059601 filed Mar. 29, 2013, the contents of all of which are incorporated herein by reference in their entirety.

FIELD

The present invention relates to a sequencer terminal block, a sequencer, and a sequencer unit.

BACKGROUND

Conventionally, in a sequencer unit used for such a system as a factory automation (FA) device, a plurality of sequencers are arrayed and fixed. Such a sequencer includes a terminal block on which a plurality of terminal connection portions, to which wires for input and output of signals are connected, are arrayed. If the wires connected to the terminal connection portions are not held together and are left as they are, the wires may interfere with an adjacent sequencer, thus making attachment and detachment of the sequencer difficult. Furthermore, the visibility of the wiring state is likely to decrease, thereby delaying detection of dropout or the like in the wiring and making it difficult to prevent a ground fault or the like.

Therefore, the wires connected to the terminal connection portions are generally banded and held together with a banding band. To further prevent the wires from spreading apart, the banding band for holding the wires together is fixed. For example, in Patent Literature 1, a band attachment portion for fixing a banding band to a terminal block is provided.

CITATION LIST

Patent Literature

Patent Literature 1: Japanese Utility Model Application Publication No. S61-63776

SUMMARY

Technical Problem

However, according to the conventional technique described above, the band attachment portion is provided at a position where the band attachment portion overlaps with a route for drawing around the wires, thus reducing the wiring space. Accordingly, the band attachment portion may disturb wiring work and the workability may be deteriorated.

The present invention has been achieved in view of the above problems, and an object of the present invention is to provide a sequencer terminal block having a band attachment portion that is less likely to interfere with wiring.

Solution to Problem

According to an aspect of the present invention in order to solve the problems and achieve the object, there is provided a sequencer terminal block having a terminal connection surface on which a plurality of terminal connection portions are arrayed, to each of which a terminal can be connected, the sequencer terminal block including a band attachment portion formed to protrude in a first direction parallel to an array direction of the terminal connection portions, wherein the band attachment portion includes two first legs formed to protrude in the first direction, and a first joining portion that joins ends of the two first legs to each other, and an area surrounded by an attachment-portion forming surface on which the band attachment portion is formed, the first legs, and the first joining portion corresponds to an insertion hole into which a banding band can be inserted.

Advantageous Effects of Invention

According to the present invention, the sequencer terminal block having the band attachment portion that is less likely to interfere with wiring can be provided.

BRIEF DESCRIPTION OF DRAWINGS

FIG. 10-1 is a diagram illustrating a procedure for surface texturing around the band attachment portion.

FIG. 10-2 is a diagram illustrating a procedure for surface texturing around the band attachment portion.

FIG. 10-3 is a diagram illustrating a procedure for surface texturing around the band attachment portion.

FIG. 11-1 is a diagram illustrating a procedure for surface texturing around the band attachment portion illustrated as a comparative example.

FIG. 11-2 is a diagram illustrating a procedure for surface texturing around the band attachment portion illustrated as the comparative example.

FIG. 11-3 is a diagram illustrating a procedure for surface texturing around the band attachment portion illustrated as the comparative example.

DESCRIPTION OF EMBODIMENTS

Exemplary embodiments of a sequencer terminal block, a sequencer, and a sequencer unit according to the present invention will be explained below in detail with reference to the accompanying drawings. The present invention is not limited to the embodiments.

First Embodiment

Figure 1:
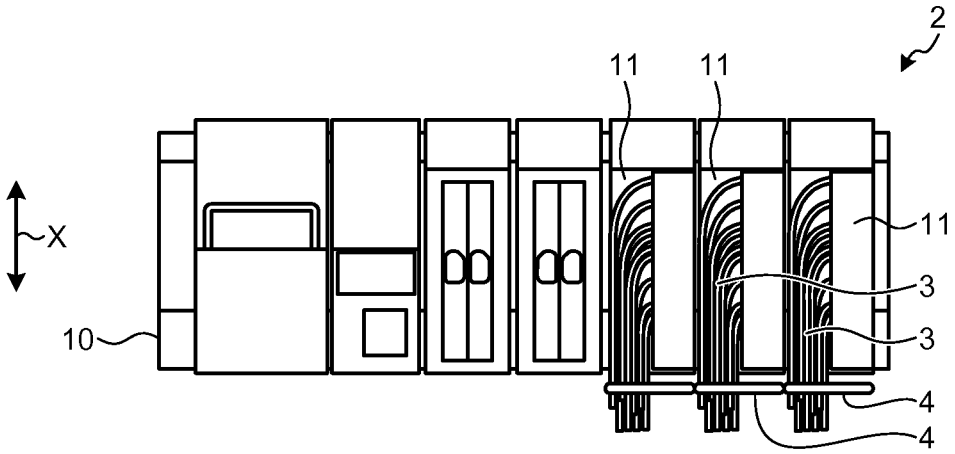
FIG. 1 is a front view illustrating a schematic configuration of a sequencer unit according to a first embodiment of the present invention.
Figure 2:
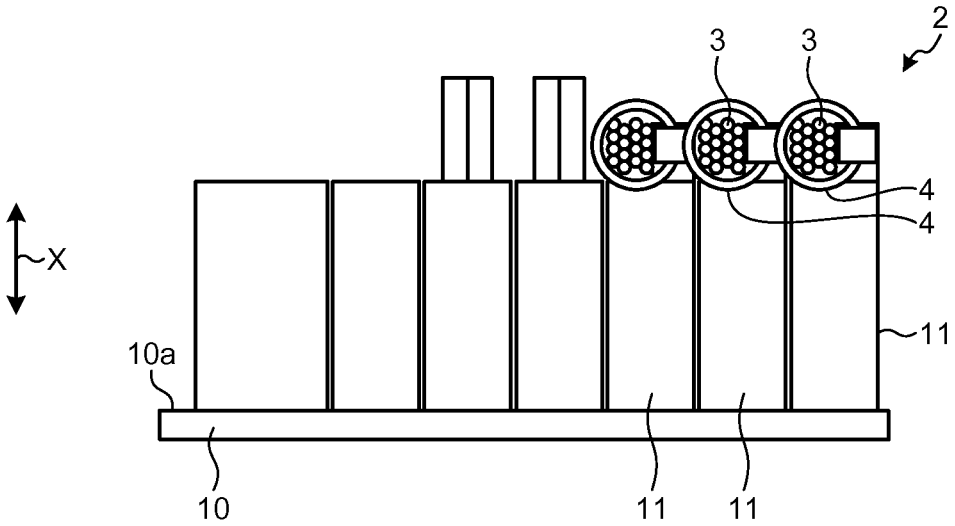
FIG. 2 is a bottom view of the sequencer unit.

FIG. 1 is a front view illustrating a schematic configuration of a sequencer unit according to a first embodiment of the present invention. FIG. 2 is a bottom view of the sequencer unit. A sequencer unit 2 includes a base 10 and a plurality of sequencers 11. The sequencers 11 are arrayed and fixed to the base 10.

On surfaces of the base 10 and the sequencers 11 facing each other, connectors (not illustrated) are provided for fitting the base 10 and the sequencers 11. The sequencers 11 are electrically connected to each other via the connectors through which transmission and reception of information and transmission and reception of power are performed.

Figure 3:
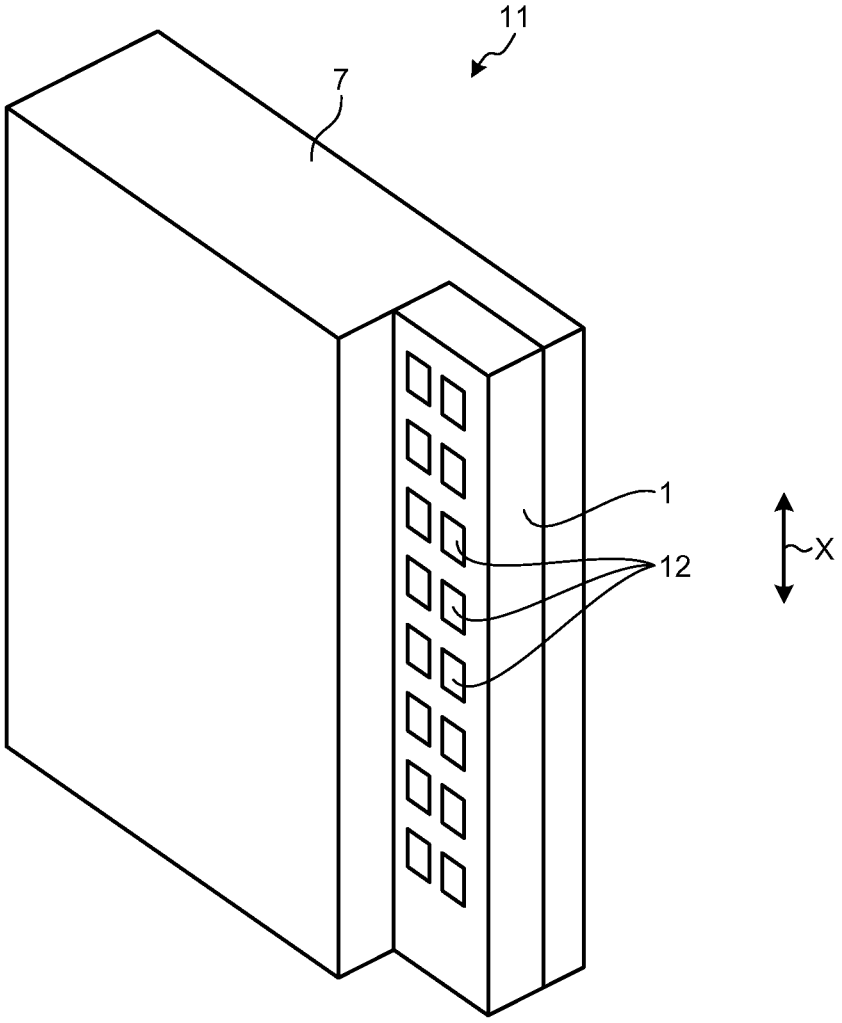
FIG. 3 is a perspective view illustrating a schematic configuration of a sequencer including a sequencer terminal block.
Figure 4:
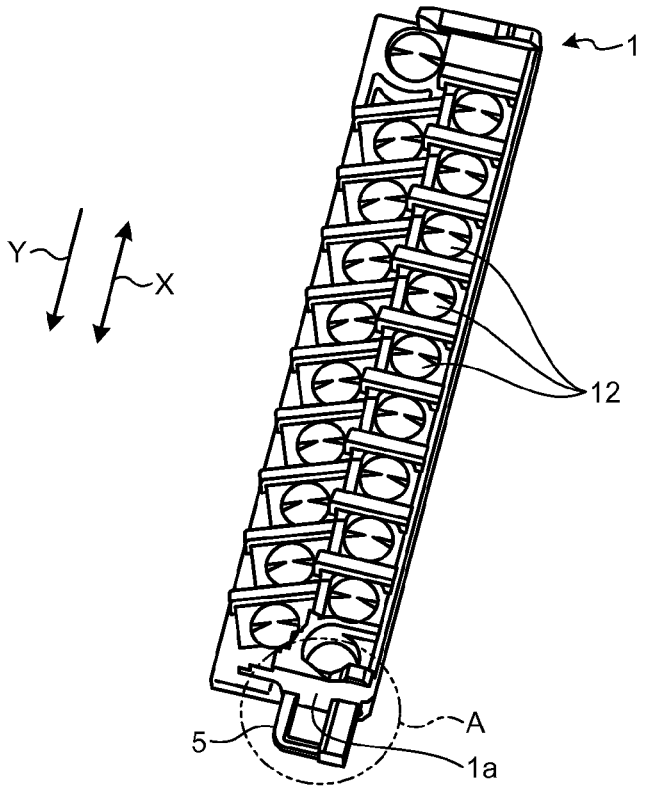
FIG. 4 is a diagram illustrating a schematic configuration of the sequencer terminal block and is a perspective view of the sequencer terminal block as viewed from a front side.

FIG. 3 is a perspective view illustrating a schematic configuration of the sequencer including a sequencer terminal block. FIG. 4 is a diagram illustrating a schematic configuration of the sequencer terminal block and is a perspective view of the sequencer terminal block as viewed from the front side. As illustrated in FIG. 3, the sequencer 11 has a shape close to a cuboid as a whole, and includes a sequencer terminal block 1 on the front side of a body portion 7.

On the sequencer terminal block 1, a plurality of terminal connection portions 12 capable of connecting wires are arrayed in a direction indicated by an arrow X. The direction of the arrow X is perpendicular to an array direction of the sequencers 11 and parallel to a sequencer attachment surface 10*a* of the base 10. For example, as illustrated in FIG. 4, each of the terminal connection portions 12 is configured to fix a terminal (not illustrated) provided at an end of the wire with a screw.

Figure 5:
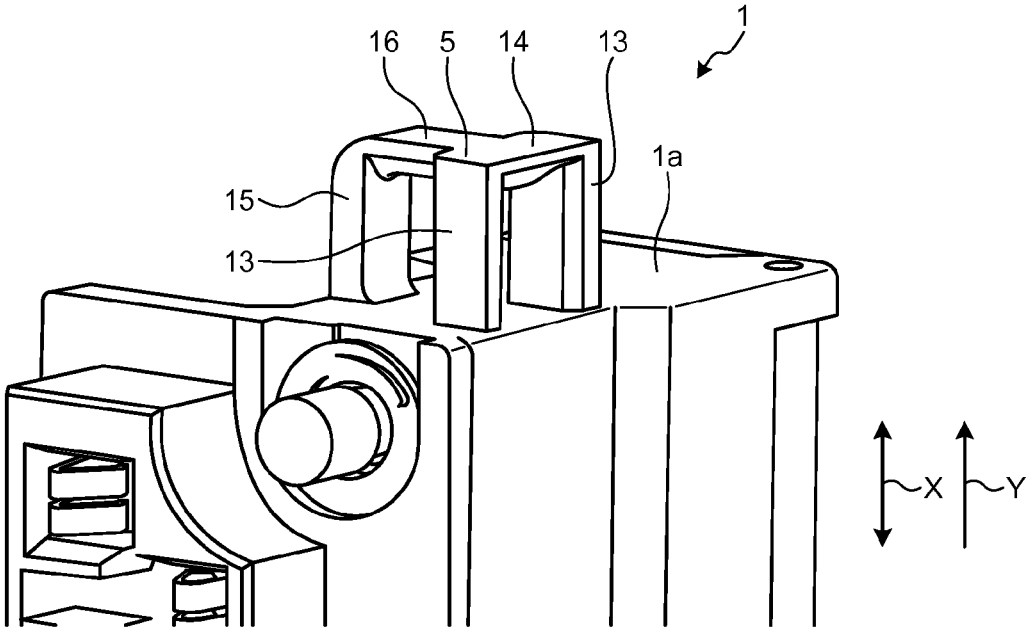
FIG. 5 is a partially enlarged view illustrating a part A illustrated in FIG. 4.

FIG. 5 is a partially enlarged view illustrating a part A illustrated in FIG. 4. A band attachment portion 5 is provided on one of the surfaces of the sequencer terminal block 1, which corresponds to a bottom surface (an attachment-portion forming surface 1*a*) of the sequencer 11 in a state of being attached to the sequencer 11. The band attachment portion 5 is provided to protrude in a direction indicated by an arrow Y (first direction). The direction of the arrow Y is parallel to the array direction of the terminal connection portions 12 (the direction indicated by the arrow X) with respect to the attachment-portion forming surface 1*a*. Because this structure is formed in a housing of the terminal block body, the structure does not adversely affect the wiring performance.

Figure 6:
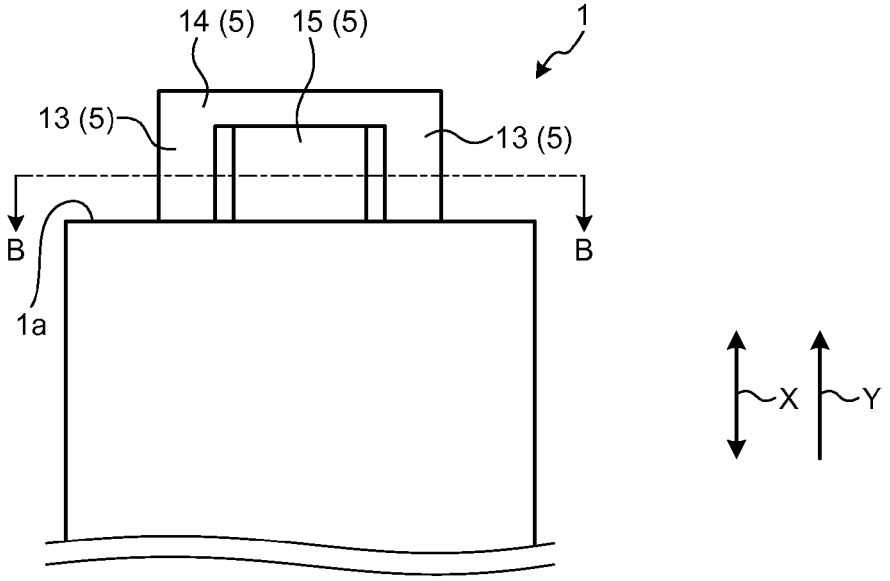
FIG. 6 is a right side view of a band attachment portion.
Figure 7:
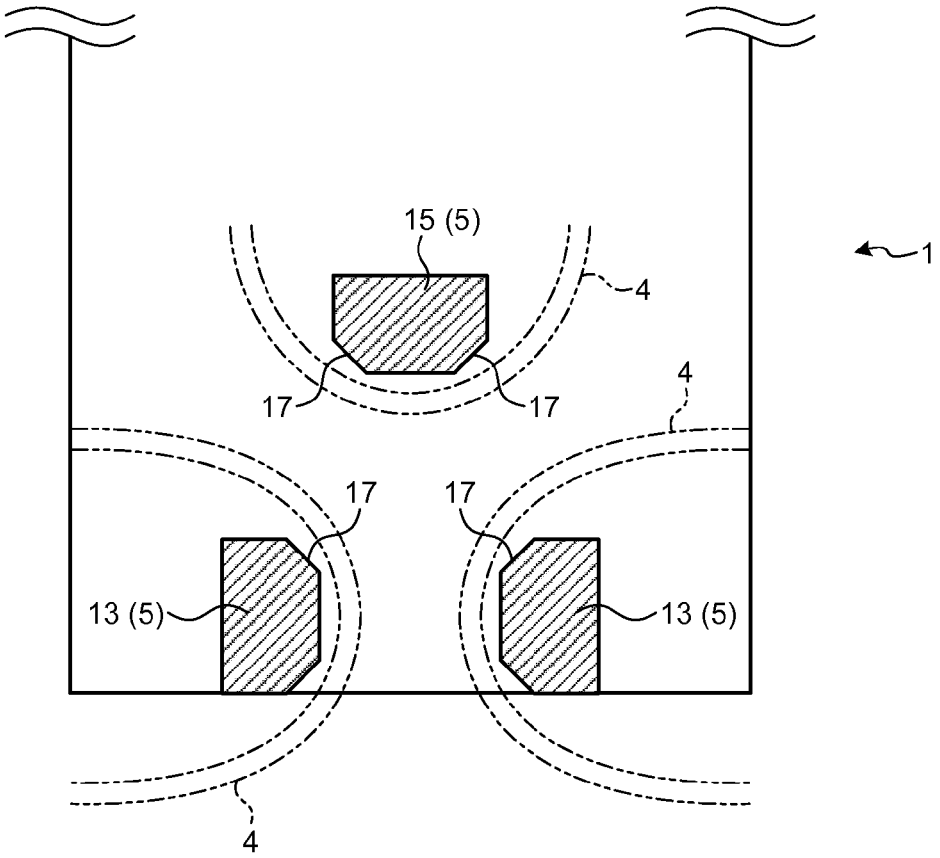
FIG. 7 is a sectional view taken in the direction of arrows B-B illustrated in FIG. 6.

FIG. 6 is a right side view of the band attachment portion. FIG. 7 is a sectional view taken in a direction of arrows B-B illustrated in FIG. 6. The band attachment portion 5 includes first legs 13, a first joining portion 14, a second leg 15, and a second joining portion 16.

The number of the first legs 13 is two and the first legs 13 are formed to protrude from the attachment-portion forming surface 1*a* in the direction indicated by the arrow Y. As illustrated in FIG. 7, the two first legs 13 are formed at an edge of the attachment-portion forming surface 1*a*. The first joining portion 14 joins the ends of the first legs 13 to each other. Accordingly, the band attachment portion 5 has a ring shape, so that an area surrounded by the attachment-portion forming surface 1*a*, the first legs 13, and the first joining portion 14 corresponds to an insertion hole into which a banding band 4 can be inserted.

The second leg 15 is formed to protrude from the attachment-portion forming surface 1*a* in the direction indicated by the arrow Y. The second joining portion 16 joins an end of the second leg 15 and a middle part of the first joining portion 14. Accordingly, a combination of the first joining portion 14 and the second joining portion 16 has a T shape as viewed in a plan view. An area surrounded by the attachment-portion forming surface 1*a*, the first legs 13, the first joining portion 14, the second joining portion 16, and the second leg 15 also corresponds to an insertion hole into which the banding band 4 can be inserted. As a result, as illustrated in FIG. 7, three routes into which the banding band 4 can be inserted are formed.

Figure 8:
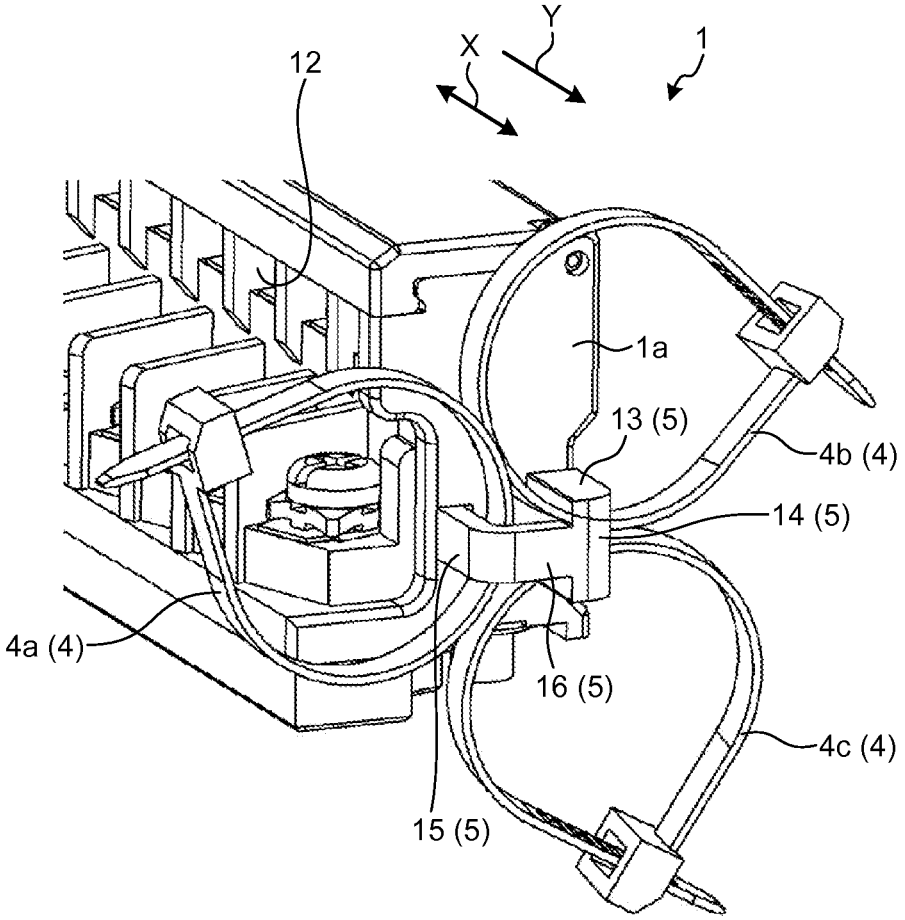
FIG. 8 is a diagram schematically illustrating a state where a banding band is attached to the band attachment portion.

FIG. 8 is a diagram schematically illustrating a state where the banding bands 4 are attached to the band attachment portion 5. As illustrated in FIG. 8, the three routes into each of which the banding band 4 can be inserted are formed, so that a plurality of the banding bands 4 can be attached to the single band attachment portion 5.

As illustrated in FIG. 7, chamfering process is done for corners 17 of the first legs 13, the first joining portion 14, the second leg 15, and the second joining portion 16, facing the inside of an area surrounded by these portions, that is, the corners 17 facing the insertion holes.

Figure 9:
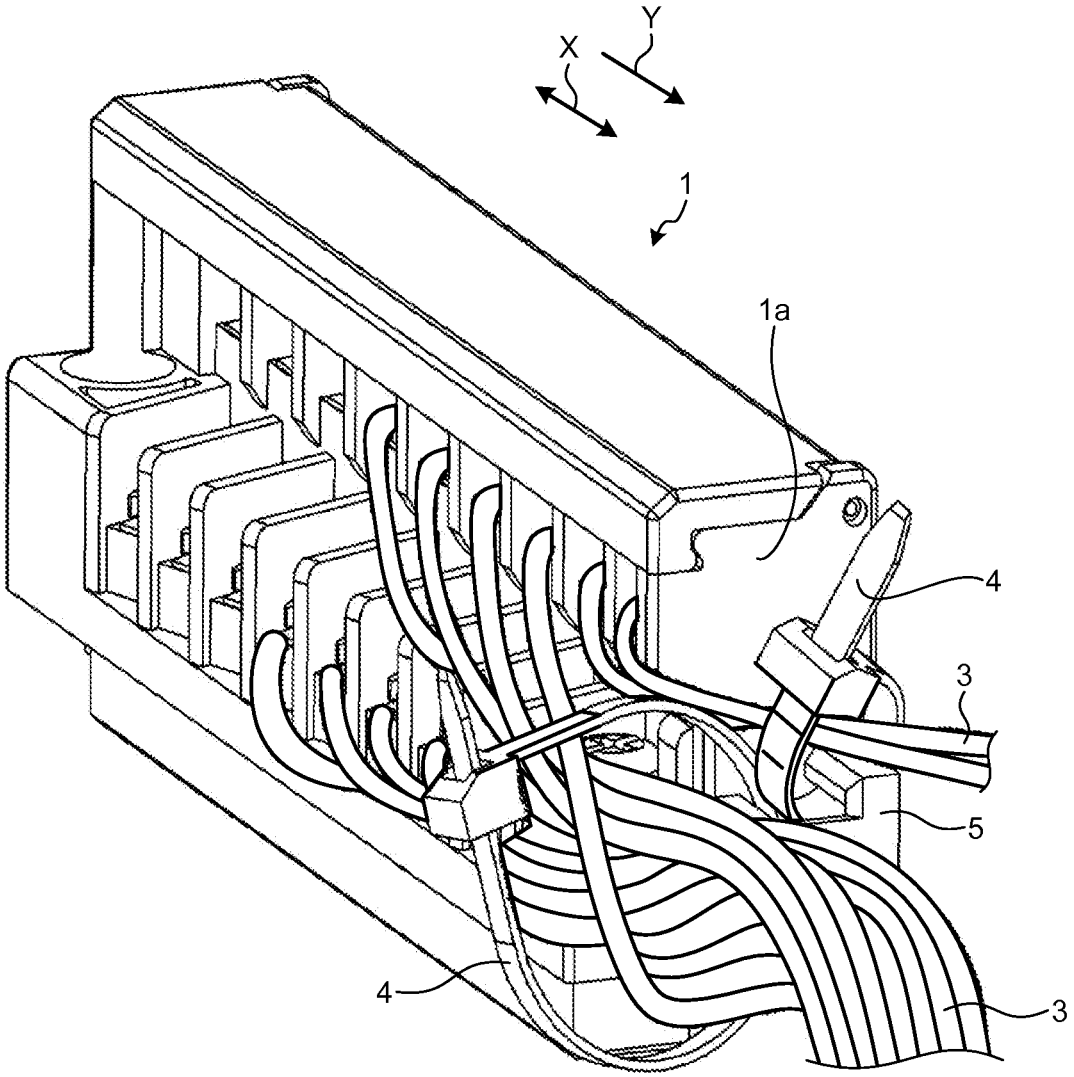
FIG. 9 is a diagram schematically illustrating a state where wires are held together by the banding band.

FIG. 9 is a diagram schematically illustrating a state where wires 3 are held together with the banding bands 4. As illustrated in FIG. 9, the banding bands 4 are used for banding a plurality of wires 3 connected to the terminal connection portions 12 together. The banding bands 4 are fastened to the band attachment portion 5 at the time of banding the wires 3 together. The wires 3 connected to the terminal connection portions 12 pass on the surface where the terminal connection portions 12 are provided and are drawn around toward the bottom surface side of the sequencer 11 (see also FIGS. 1 and 2).

According to the sequencer terminal block 1, the sequencer 11, and the sequencer unit 2 described above, the band attachment portion 5 is formed to protrude toward the direction indicated by the arrow Y parallel to the array direction of the terminal connection portions 12 on the sequencer terminal block 1. Therefore, as illustrated in FIG. 9, the band attachment portion 5 is provided at a position away from wiring routes of the wires 3 passing on the surface where the terminal connection portions 12 are provided. Accordingly, the band attachment portion 5 is less likely to interfere with the wiring work, and deterioration of workability can be suppressed.

By combining the wires 3 with the banding bands 4 so as to fix the wires 3 to the sequencer terminal block 1, the appearance of the system is improved and the wires 3 are less likely to interfere with an adjacent sequencer 11, thereby facilitating attachment/detachment of the sequencer 11.

Furthermore, the wires 3 and the sequencer terminal block 1 are combined. In a case that the sequencer terminal block 1 is detached from the body portion 7 of the sequencer 11, the detached sequencer terminal block 1 can be attached to another body portion 7 of another sequencer 11 and used as it is.

Tensile strength against pulling of the wires 3 is improved. Even if the wires 3 drop out, the possibility of a grounding fault due to the dropping can be decreased because the wires 3 are combined with the banding bands 4.

As illustrated in FIG. 8, because the plurality of the banding bands 4 can be fixed to the band attachment portion 5, the wires 3 can be divided into several groups and held together. Also in this case, because the banding bands 4 are less likely to interfere with each other, the workability can be improved. Because the wires can be divided into several groups and held together, wires that are hard to hold together, such as signal wires and power wires, can be divided into groups and held together.

By selecting the insertion hole to be used, a fixing method can be selected according to the purpose. For example, when it is desired to draw out wires downward and fix the wires, the insertion hole can be selected as in the case of a banding band 4*a* illustrated in FIG. 8. When it is desired to draw out the wires to the front and fix crossover wires to the terminal block of an adjacent sequencer 11, the insertion hole can be selected as in the case of a banding band 4*b* illustrated in FIG. 8. Further, when it is desired to draw wires toward the base 10 to make it hard to see and fix the wires with an improved appearance, the insertion hole can be selected as in the case of a banding band 4*c* illustrated in FIG. 8. In this way, the banding band 4 can be fixed in an appropriate orientation for the wiring route by selecting an insertion hole into which the banding band 4 is inserted even if the plurality of the banding bands 4 are not necessarily used.

As illustrated in FIG. 7, the corners 17 facing the insertion holes are chamfered. When the banding band 4 is inserted into the insertion hole, an end of the banding band 4 is easily guided into the insertion hole smoothly by the chamfered corners 17. Therefore, the banding band 4 is easily inserted into the insertion hole, and attachment work of the banding band 4 can be facilitated. Accordingly, the workability in a dark place can be also improved.

The corners 17 are portions with which the banding band 4 comes in contact when the banding band 4 is fastened. Therefore, because the corners 17 are chamfered, a local load is less likely to be applied to the banding band 4. Accordingly, the banding band 4 is less likely to be damaged.

Surface texturing may be performed on the surface of the sequencer terminal block 1. According to the band attachment portion 5 of the sequencer terminal block 1 of the first embodiment, the operability of surface texturing can be improved and the appearance of the sequencer terminal block 1 after having been subjected to the surface texturing can be improved. This point is described below in detail with reference to the drawings.

Figures 1, 10:
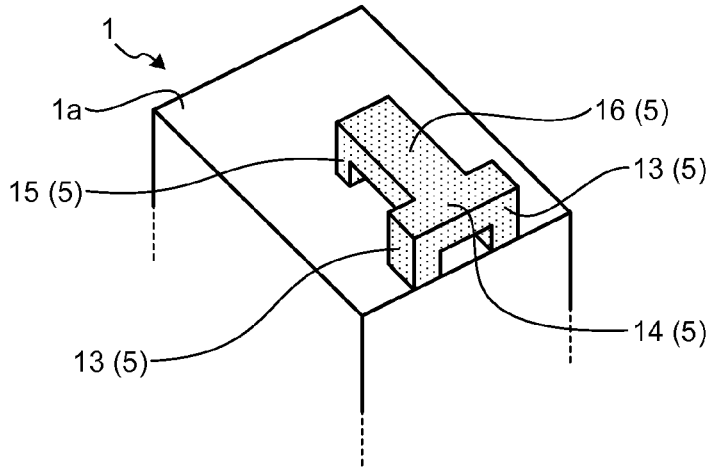
Figures 2, 10:
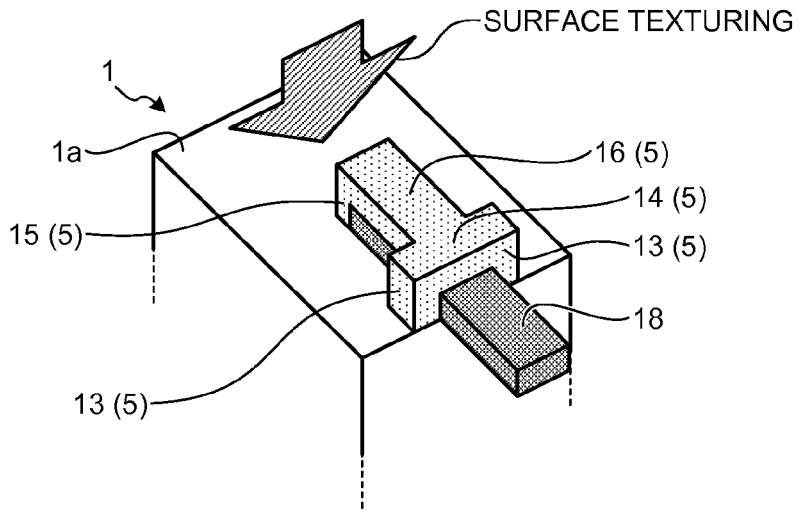
Figures 3, 10:
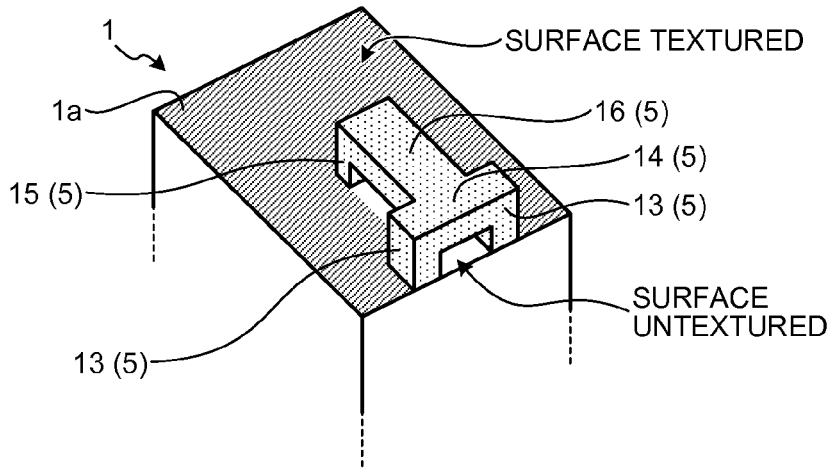

A procedure for surface texturing is described first. FIGS. 10-1 to 10-3 are diagrams illustrating a procedure for surface texturing around the band attachment portion 5. FIG. 10-1 illustrates a vicinity of the band attachment portion 5 in a state where the surface texturing is not performed. As illustrated in FIG. 10-2, in a state where a mold slide core 18 is inserted as a jig into the insertion hole of the band attachment portion 5, the surface texturing is performed onto the surface of the sequencer terminal block 1 including the attachment-portion forming surface 1*a*.

At this time, the surface texturing is not performed on an area covered with the mold slide core 18, which is provided as an area not subjected to the surface texturing. However, as illustrated in FIG. 10-3, because the first legs 13 of the band attachment portion 5 are formed at the edge of the attachment-portion forming surface 1*a*, most of the area not subjected to the surface texturing is hidden by the band attachment portion 5. Therefore, the area not subjected to the surface texturing is hardly viewed, thereby improving the appearance of the sequencer terminal block 1.

The width of the area not subjected to the surface texturing depends on the width of the mold slide core 18. Because the mold slide core 18 is inserted from the insertion hole surrounded by the attachment-portion forming surface 1*a*, the first legs 13, and the first joining portion 14, the width of the area not subjected to the surface texturing does not become larger than the width of the insertion hole.

Accordingly, by making the width of the second joining portion 16 to be at least larger than the width of the insertion hole surrounded by the attachment-portion forming surface 1*a*, the first legs 13, and the first joining portion 14, the area not subjected to the surface texturing can be reliably hidden by the undersides of the first joining portion 14 and the second joining portion 16 as viewed in a plan view. Further, by making the width of the second joining portion 16 larger, the area not subjected to the surface texturing can be made less visible.

Because the second leg 15 is provided in the insertion direction of the mold slide core 18, the mold slide core 18 can be inserted until striking against the second leg 15. Therefore, fine adjustment or the like of the insertion amount is not required at the time of inserting the mold slide core 18, and the operability can be improved.

Figures 1, 11:
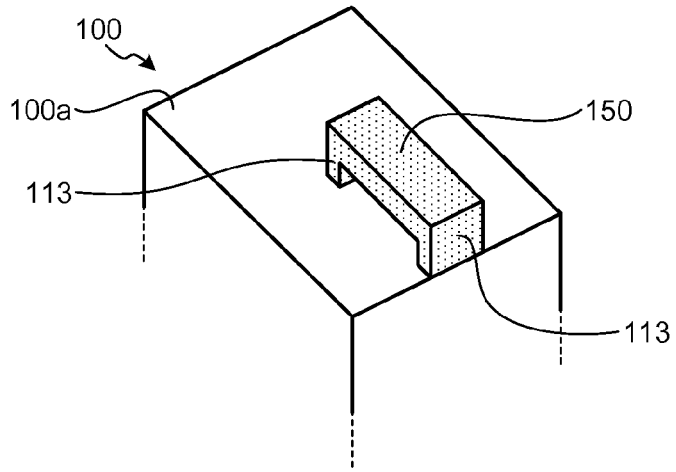
Figures 2, 11:
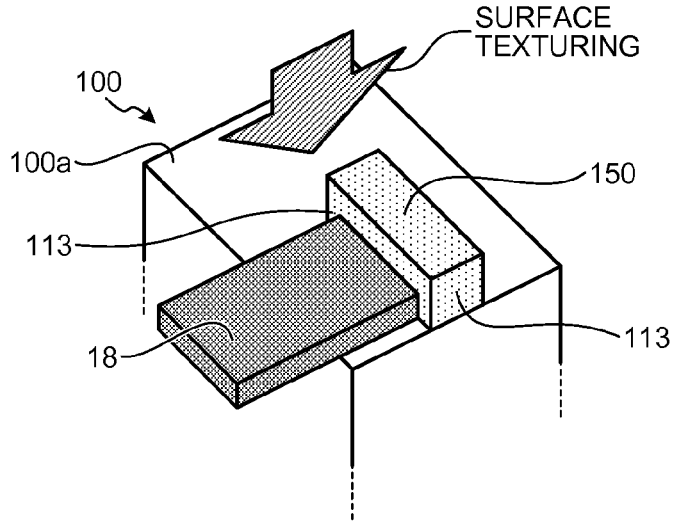
Figures 3, 11:
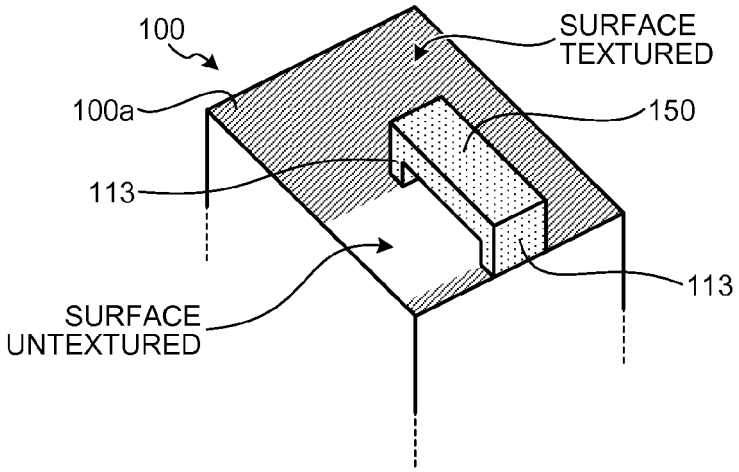

A procedure for surface texturing to a sequencer terminal block 100 including a band attachment portion 150 illustrated is now described as a comparative example. FIGS. 11-1 to 11-3 are diagrams illustrating a procedure for surface texturing around a band attachment portion illustrated as the comparative example.

In the band attachment portion 150 illustrated as the comparative example, one of legs 113 is formed at a position away from an edge of an attachment-portion forming surface 100*a*. Therefore, due to the mold slide core 18 for covering, a part of an area not subjected to the surface texturing is not hidden by the band attachment portion 150 and exposed, thus deteriorating the appearance of the sequencer terminal block 100. In contrast thereto, according to the present embodiment, as described above, because the area not subjected to the surface texturing is less visible, the appearance can be improved.

Figure 12:
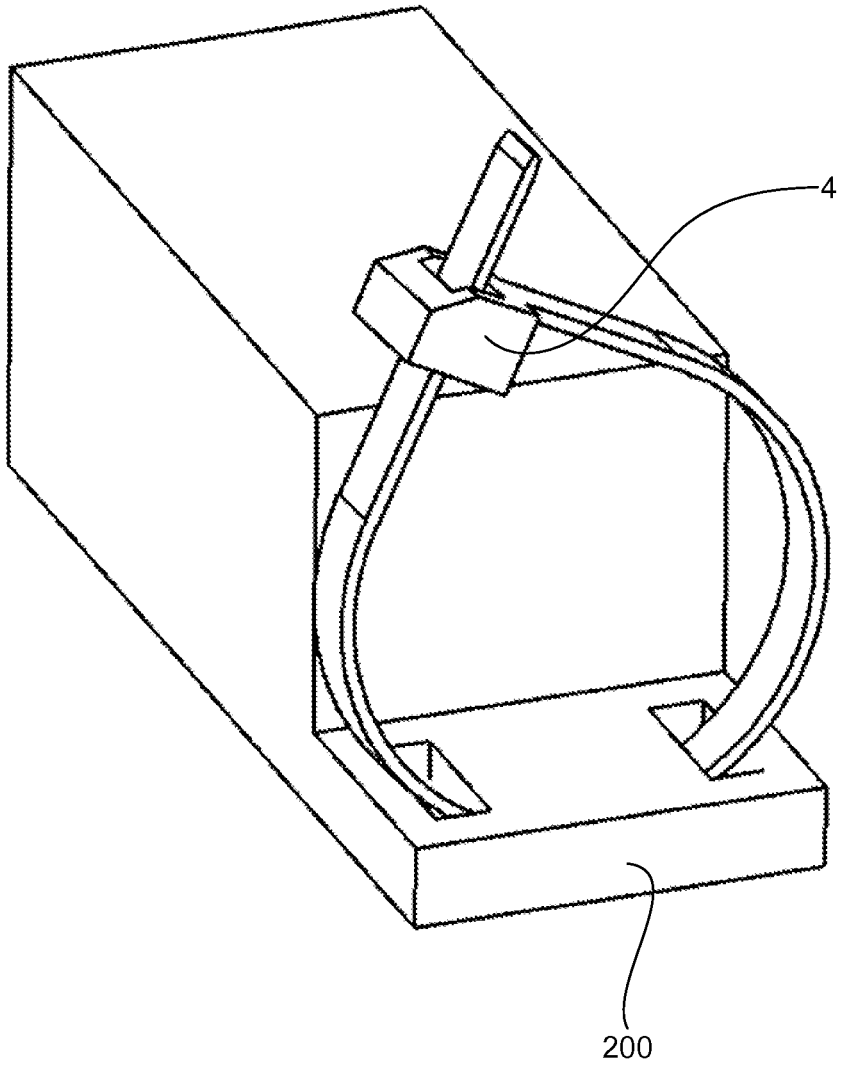
FIG. 12 is a partially-enlarged perspective view of the band attachment portion illustrated as another comparative example.

FIG. 12 is a partially-enlarged perspective view of a band attachment portion illustrated as another comparative example. In a band attachment portion 200 illustrated as another comparative example, two working steps are required at the time of providing one banding band 4, one is to insert an end of the banding band 4 into one of insertion holes and the other is draw out the end of the banding band 4 from the other insertion hole. Therefore, an increase in the labor hours and deterioration of the workability at the time of providing the banding band 4 is likely to be a problem. In contrast thereto, according to the present embodiment, because the banding band 4 can be provided only by inserting an end of the banding band 4 into the insertion hole once, an increase in the labor hours can be suppressed and the workability can be improved.

Second Embodiment

Figure 13:
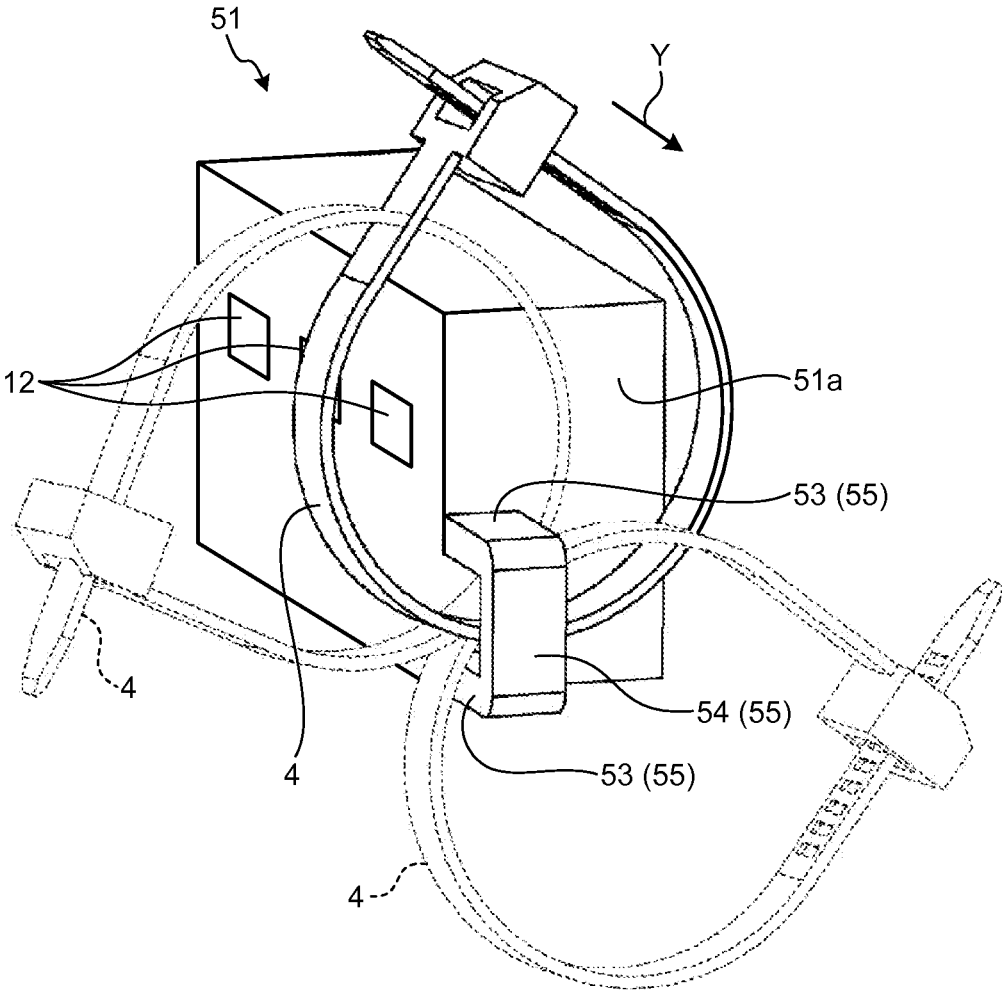
FIG. 13 is a partially-enlarged perspective view illustrating a band attachment portion of a sequencer terminal block according to a second embodiment of the present invention and is a diagram illustrating a state where a banding band is attached to the band attachment portion.

FIG. 13 is a partially-enlarged perspective view illustrating a band attachment portion of a sequencer terminal block according to a second embodiment of the present invention and is a diagram illustrating a state where a banding band is attached to the band attachment portion. Constituent elements identical to those in the first embodiment described above are denoted by like reference signs, and detailed descriptions thereof are omitted.

In a band attachment portion 55 of a sequencer terminal block 51 according to the second embodiment, the second leg 15 and the second joining portion 16 (see also FIG. 5, and the like) described in the above embodiment are not provided. Meanwhile, because two first legs 53 are formed at an edge of an attachment-portion forming surface 51*a* as in the first embodiment, an area not subjected to the surface texturing can be hidden by the band attachment portion 55 including a first joining portion 54. However, because the mold slide core 18 (see also FIG. 10-2) cannot be struck against the second leg 15, the operability slightly decreases.

As in the first embodiment, the band attachment portion 55 is formed to protrude in the direction indicated by the arrow Y parallel to the array direction of the terminal connection portions 12. The band attachment portion 55 is provided at a position away from the wiring route of the wires 3 connected to the terminal connection portions 12. Accordingly, the band attachment portion 55 is less likely to interfere with the wiring work, and deterioration of the workability can be suppressed.

The banding band 4 can be provided only by inserting an end of the banding band 4 into the insertion hole once. Therefore, unlike the band attachment portion 200 illustrated in FIG. 12, after inserting the banding band 4 into one of insertion holes, it is not required to draw out the banding band 4 with the position thereof matched with the other insertion hole. Accordingly, an increase in the labor hours can be suppressed and the workability can be improved.

INDUSTRIAL APPLICABILITY

As described above, the sequencer terminal block according to the present invention is useful for a sequencer terminal block where a plurality of wires are connected to terminal connection portions.

REFERENCE SIGNS LIST

1 sequencer terminal block, 1*a* attachment-portion forming surface, 2 sequencer unit, 3 wire, 4*a*, 4*b*, 4*c* banding band, 5 band attachment portion, 7 body portion, 10 base, 10*a* sequencer attachment surface, 11 sequencer, 12 terminal connection portion, 13 first leg, 14 first joining portion, 15 second leg, 16 second joining portion, 17 corner, 18 mold slide core, 51 sequencer terminal block, 51*a* attachment-portion forming surface, 53 first leg, 54 first joining portion, 55 band attachment portion, 100 sequencer terminal block, 113 leg, 150, 200 band attachment portion.

The invention claimed is:

1. A sequencer terminal block having a terminal connection surface on which a plurality of terminal connection portions are arrayed, to each of which a terminal can be connected, the sequencer terminal block comprising a band attachment portion formed to protrude in a first direction parallel to an array direction of the terminal connection portions, wherein the band attachment portion includes two first legs formed to protrude in the first direction, and a first joining portion that joins ends of the two first legs to each other, an area surrounded by an attachment-portion forming surface on which the band attachment portion is formed, the first legs, and the first joining portion corresponds to an insertion hole into which a banding band can be inserted, a gap between the attachment-portion forming surface and the first joining portion is larger than a width of the banding band, and the first legs are arranged along a common edge of the attachment-portion forming surface.

2. The sequencer terminal block according to claim 1, wherein the band attachment portion further includes a second leg formed to protrude in the first direction from the attachment-portion forming surface, and a second joining portion that joins an end of the second leg with a middle part of the first joining portion, and a combination of the first joining portion and the second joining portion form a T-shape.

3. The sequencer terminal block according to claim 2, wherein corners of the first legs, the first joining portion, the second leg, and the second joining portion, facing an inside of an area surrounded by these portions are chamfered.

4. A sequencer comprising:

the sequencer terminal block according to claim 1; and a body portion to which the sequencer terminal block is attached.

5. A sequencer unit comprising:

a plurality of the sequencers according to claim 4; and a base on which the sequencers are arrayed and fixed.

* * * * *